US009974377B2

(12) United States Patent
Keller et al.

(10) Patent No.: US 9,974,377 B2
(45) Date of Patent: May 22, 2018

(54) DUAL-ENDED LIP BALM CONTAINER

(71) Applicant: Pfizer Inc., New York, NY (US)

(72) Inventors: Matthew Clifton Keller, Richmond, VA (US); David Dombrowski, Williamsburg, VA (US); David Charles Fuhrmeister, Chester Springs, PA (US); William H. Valls, Loveland, OH (US); Zachariah S. Simmering, Mansfield, OH (US); Jonathon Keith Markey, Greensboro, NC (US)

(73) Assignee: Pfizer Inc., New York, NY (US)

( * ) Notice: Subject to any disclaimer, the term of this patent is extended or adjusted under 35 U.S.C. 154(b) by 0 days. days.

(21) Appl. No.: 15/275,783

(22) Filed: Sep. 26, 2016

(65) Prior Publication Data

US 2017/0215552 A1 Aug. 3, 2017

Related U.S. Application Data

(60) Provisional application No. 62/289,424, filed on Feb. 1, 2016.

(51) Int. Cl.
*A45D 40/20* (2006.01)
*A45D 40/24* (2006.01)
(Continued)

(52) U.S. Cl.
CPC ..... *A45D 40/24* (2013.01); *A45D 40/0068* (2013.01); *A45D 40/02* (2013.01);
(Continued)

(58) Field of Classification Search
CPC .... B29C 31/04; A45D 40/0068; A45D 40/16; A45D 40/20; A45D 40/24
See application file for complete search history.

(56) References Cited

U.S. PATENT DOCUMENTS 1,626,311 A 4/1927 Tipton
1,626,312 A 4/1927 Tipton
(Continued)

FOREIGN PATENT DOCUMENTS

CH 268337 A 5/1950
CN 2293242 Y 10/1998
(Continued)

OTHER PUBLICATIONS

Grob Cosmetics, Swiss Design 116444, Jun. 29, 1988.
(Continued)

*Primary Examiner* — Jennifer C Chiang

(74) *Attorney, Agent, or Firm* — Paula K. Davis; Jeffrey M. Gold

(57) ABSTRACT

A three to six sided lip balm applicator of the present invention comprises a cap, a liner, and a base, having engagement assemblies for engaging the cap to the liner, the liner to the base, and a base from one lip balm applicator to an equivalent base from another lip balm applicator to form a lip balm container. The base comprises a partition with stabilizers which emerge from the partition and extend radially toward and overhang an aperture in the partition. The lip balm applicator may contain a domed lip balm, filled directly into the lip balm applicator or components thereof as a mold for manufacturing the domed lip balm, filled to a fill level approaching the partition top but not touching the partition top.

5 Claims, 11 Drawing Sheets

(51) Int. Cl.

| | |
|---|---|
| ***A45D 40/00*** | (2006.01) |
| ***A45D 40/02*** | (2006.01) |
| ***A45D 40/06*** | (2006.01) |
| ***A45D 40/16*** | (2006.01) |

(52) U.S. Cl.

CPC ..... *A45D 40/06* (2013.01); *A45D 40/16* (2013.01); *A45D 40/20* (2013.01)

(56) References Cited

U.S. PATENT DOCUMENTS

| | | | | |
|---|---|---|---|---|
| 1,852,455 | A | 4/1932 | Friedman | |
| 1,899,748 | A | 2/1933 | Cornell | |
| 1,953,911 | A | 4/1934 | Parkin | |
| 2,171,112 | A | 8/1939 | Hoffman | |
| 2,177,651 | A | 10/1939 | Harris | |
| 2,201,467 | A | 5/1940 | Bloom | |
| 2,264,482 | A | 12/1941 | Ridner | |
| 2,314,338 | A | 3/1943 | Graves et al. | |
| 2,414,245 | A | 1/1947 | Rudd | |
| 2,573,828 | A | 11/1951 | Braselton | |
| 2,710,614 | A | 6/1955 | Dulberg | |
| 2,745,642 | A | 5/1956 | Hermann | |
| 2,859,085 | A | 11/1958 | Morrison | |
| 3,431,918 | A | 3/1969 | Neumann | |
| 3,741,379 | A | 6/1973 | Kappler et al. | |
| 3,843,120 | A | 10/1974 | Ricci | |
| 4,235,557 | A | 11/1980 | Hayes | |
| 4,728,210 | A | 3/1988 | Wallace | |
| 5,025,817 | A | 6/1991 | Wen | |
| 5,044,496 | A | 9/1991 | Tanaka et al. | |
| 5,137,185 | A | 8/1992 | Mitchell | |
| D348,123 | S | 6/1994 | Wu | |
| 5,326,185 | A | 7/1994 | Dornbusch et al. | |
| 5,496,122 | A | 3/1996 | Fattori | |
| 5,503,825 | A | 4/1996 | Lane | |
| 5,542,557 | A | 8/1996 | Koyama et al. | |
| D377,849 | S | 2/1997 | Fabrisi | |
| 5,609,430 | A | 3/1997 | Mazzola et al. | |
| 5,738,123 | A | 4/1998 | Szekely | |
| 5,799,667 | A | 9/1998 | Szekely | |
| 5,800,086 | A | 9/1998 | Piscopo et al. | |
| 5,813,784 | A | 9/1998 | Durliat | |
| D406,397 | S | 3/1999 | Nahum-Albright | |
| 5,884,637 | A | 3/1999 | Joulia | |
| D410,570 | S | 6/1999 | Lerolle | |
| 5,954,442 | A | 9/1999 | Monin-Bareil | |
| 5,984,553 | A | 11/1999 | Piscopo et al. | |
| D420,466 | S | 2/2000 | Coates et al. | |
| D420,767 | S | 2/2000 | Coates et al. | |
| D422,748 | S | 4/2000 | Lang | |
| 6,050,438 | A | 4/2000 | Kovens et al. | |
| 6,193,427 | B1 | 2/2001 | Benguigui | |
| 6,391,972 | B1 | 5/2002 | Hatakeyama | |
| D465,614 | S | 11/2002 | Petit | |
| 6,568,529 | B2 | 5/2003 | McMurrey | |
| D484,646 | S | 12/2003 | Ditrichstein | |
| 6,682,242 | B1 | 1/2004 | Montoli | |
| 6,688,795 | B1 | 2/2004 | Jacob et al. | |
| 6,702,494 | B2 | 3/2004 | Dumler et al. | |
| 6,773,187 | B2 | 8/2004 | Gueret | |
| 7,025,520 | B2 | 4/2006 | Petit | |
| D534,076 | S | 12/2006 | Green et al. | |
| D538,478 | S | 3/2007 | Chen | |
| D554,529 | S | 11/2007 | Green et al. | |
| D562,699 | S | 2/2008 | Green et al. | |
| D564,900 | S | 3/2008 | Green et al. | |
| 7,367,736 | B2 | 5/2008 | Chan | |
| D583,506 | S | 12/2008 | Justice | |
| 7,631,781 | B2 | 12/2009 | Chen | |
| D612,245 | S | 3/2010 | Canamasas Puigbo | |
| 7,695,727 | B2 | 4/2010 | Magee et al. | |
| 7,699,062 | B2 | 4/2010 | Sasaki | |
| 7,802,937 | B1 | 9/2010 | Szekely | |
| D625,469 | S | 10/2010 | Dubitsky et al. | |
| D631,204 | S | 1/2011 | Dubitsky et al. | |
| D632,017 | S | 2/2011 | Lee | |
| D644,939 | S | 9/2011 | Teller et al. | |
| 8,043,017 | B2 | 10/2011 | Beierwaltes et al. | |
| D651,903 | S | 1/2012 | Teller | |
| D661,431 | S | 6/2012 | Bagley | |
| 8,226,311 | B2 | 7/2012 | Cronin | |
| D681,278 | S | 4/2013 | Schlatter | |
| 8,434,955 | B2 | 5/2013 | Rauschert et al. | |
| 8,444,337 | B2 | 5/2013 | Teller et al. | |
| D688,569 | S | 8/2013 | Weeston | |
| 8,651,308 | B1 | 2/2014 | Sung | |
| 8,668,398 | B2 | 3/2014 | Rosengard | |
| D708,789 | S | 7/2014 | Schlatter | |
| D708,790 | S | 7/2014 | Schlatter | |
| D708,791 | S | 7/2014 | Schlatter | |
| D709,652 | S | 7/2014 | Teller | |
| D710,544 | S | 8/2014 | Shen | |
| 8,834,050 | B2 | 9/2014 | Liba | |
| 8,888,391 | B2 | 11/2014 | Teller et al. | |
| D726,028 | S | 4/2015 | Thompson | |
| D732,240 | S | 6/2015 | Brown | |
| D733,967 | S | 7/2015 | Schlatter | |
| D734,550 | S | 7/2015 | Schlatter | |
| D734,894 | S | 7/2015 | Schlatter | |
| D735,413 | S | 7/2015 | Smith et al. | |
| D735,414 | S | 7/2015 | Schlatter | |
| 9,185,963 | B2 | 11/2015 | Weeston | |
| 9,585,458 | B2 * | 3/2017 | Teller | A45D 40/00 |
| 2003/0041870 | A1 | 3/2003 | Su | |
| 2003/0201201 | A1 | 10/2003 | Cheng | |
| 2006/0254945 | A1 | 11/2006 | Green et al. | |
| 2009/0090377 | A1 | 4/2009 | Tran | |
| 2011/0024316 | A1 | 2/2011 | Ginsburg | |
| 2013/0089367 | A1 | 4/2013 | Liba | |
| 2015/0251052 | A1 * | 9/2015 | Zaker | A63B 23/16 482/49 |
| 2017/0013935 | A1 * | 1/2017 | Schlatter | A45D 33/02 |
| 2017/0258200 | A1 * | 9/2017 | Rossi | A45D 40/16 |

FOREIGN PATENT DOCUMENTS

| | | | |
|---|---|---|---|
| CN | 201294954 | Y | 8/2009 |
| CN | 203041110 | U | 7/2013 |
| CN | 204378253 | U | 6/2015 |
| CN | 204467304 | U | 7/2015 |
| CN | 102805473 | B | 8/2015 |
| DE | 8433747 | U1 | 2/1985 |
| DE | 29918252 | U1 | 3/2001 |
| DE | 202006002682 | U1 | 5/2006 |
| DE | 202012104020 | U1 | 12/2012 |
| EP | 1068817 | A2 | 1/2001 |
| EP | 1832198 | A1 | 9/2007 |
| FR | 538021 | A | 6/1922 |
| FR | 1090126 | A | 3/1955 |
| FR | 2563711 | A1 | 11/1985 |
| FR | 2597733 | A1 | 10/1987 |
| FR | 2726444 | B1 | 1/1997 |
| FR | 2726443 | B1 | 4/1997 |
| FR | 2766339 | B1 | 9/1999 |
| FR | 2882235 | B1 | 4/2007 |
| FR | 3016116 | A1 | 7/2015 |
| GB | 429845 | A | 6/1935 |
| GB | 2086849 | A1 | 5/1982 |
| GB | 2162822 | B2 | 4/1988 |
| GB | 2512412 | A1 | 10/2014 |
| JP | 48-095868 | U1 | 11/1973 |
| JP | 48-095869 | U1 | 11/1973 |
| JP | 48-098379 | U1 | 11/1973 |
| JP | 58-017820 | U1 | 2/1983 |
| JP | 60-044713 | U1 | 3/1985 |
| JP | 60-083514 | U1 | 6/1985 |
| JP | 60-083515 | U1 | 6/1985 |
| JP | 60-173231 | U1 | 11/1985 |
| JP | 61-030410 | U1 | 2/1986 |
| JP | 61-197910 | U1 | 12/1986 |
| JP | 1050713 | U | 3/1989 |

(56) References Cited

FOREIGN PATENT DOCUMENTS

| | | | |
|---|---|---|---|
| JP | 70-36929 | U1 | 7/1995 |
| JP | 3519140 | B2 | 4/2004 |
| WO | WO-9106232 | A1 | 5/1991 |

OTHER PUBLICATIONS

Grob Cosmetics, Swiss Design 117848, Jan. 15, 1990.
Grob Cosmetics, UK Design 2007213 Jan. 11, 1991.
"PCT Notification of Transmittal of the International Search Report and the Written Opinion of the International Searching Authority, or the Declaration", dated Nov. 14, 2016, relating to PCT International Patent Application No. PCT/IB2016/055748 having international filing date Sep. 26, 2016.
Design U.S. Appl. No. 29/553,370, titled "Dual-Ended Container"; filed Feb. 1, 2016.
Design U.S. Appl. No. 29/553,385, titled "Container", filed Feb. 1, 2016.
Utility U.S. Appl. No. 15/275,979, titled "Dual-Ended Lip-Balm Container", filed Sep. 26, 2016.

* cited by examiner

FIG. 1A
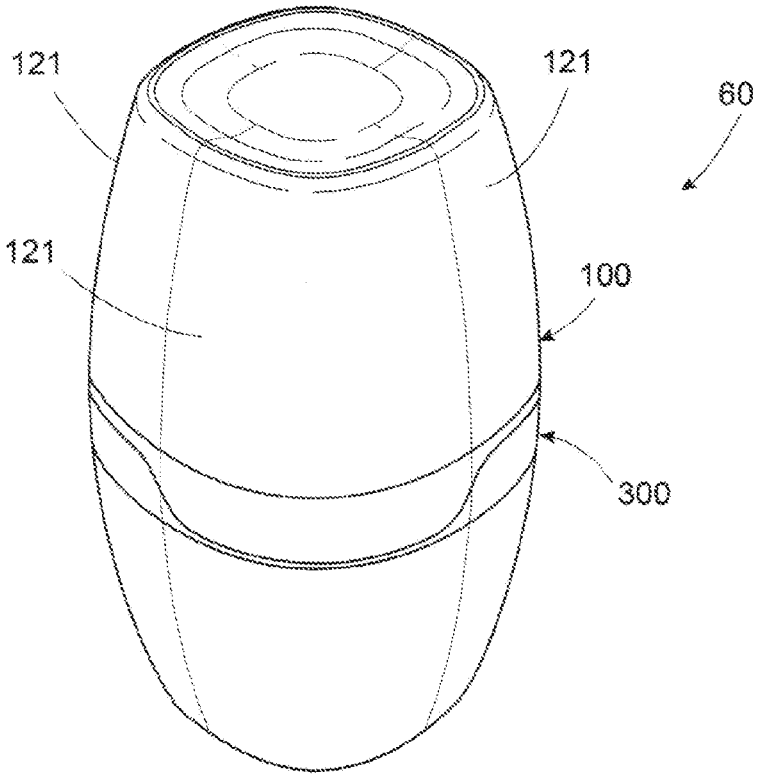
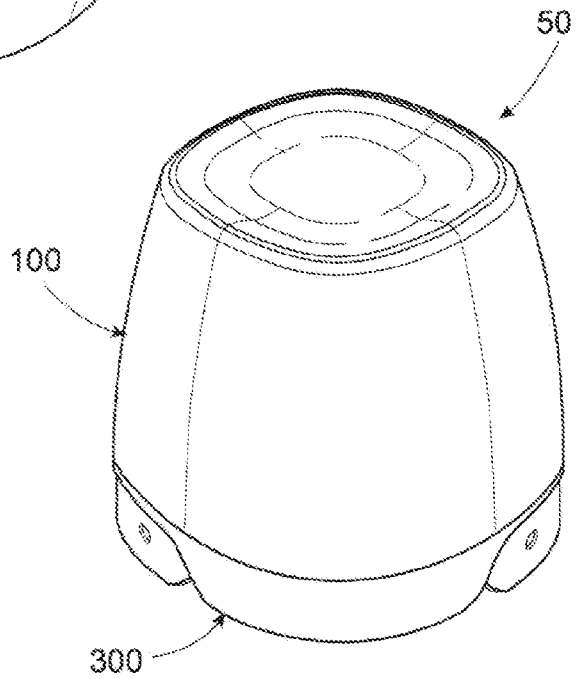
FIG. 1B

DUAL-ENDED LIP BALM CONTAINER

FIELD OF THE INVENTION

The invention relates to components for preparing and delivering lip balm, methods of filing the components and manufacturing the lip balm, and the lip balm composition contained within the components.

BACKGROUND OF THE INVENTION

Lip balms are semisolid compositions comprising moisturizers and/or moisture sealing components used to heal damaged lips and protect them from exposure to the environment. Lip balms are available in different shapes and receptacle types. Jars and pots are usually filled to a level just below the rim, and the lip balm is applied by removing a small amount of the semisolid with a finger and rubbing the finger across the lips. These lip balms are often considered by consumers to be messier and less sterile than some other lip balm forms.

Stick lip balms are cylindrical or bullet shaped and delivered through a tube. Stick lip balms are applied by extending the stick from the tube, and, using the tube as a handle, moving the lip balm over the lips. A dual-ended stick lip balm is commercially available, i.e., CHAPSTICK® MIXSTIX®, but the lip balms on each end are not detachable; only certain, fixed flavor combinations are available, and they are not replaceable upon depletion.

Recently, domed lip balms have become popular as aesthetically pleasing and easy to apply due to the rounded shape. Cube-shaped holders such as in U.S. Pat. D 735,413 and substantially spherical shaped holders such as in U.S. Pat. No. 8,888,391 am commercially available. The spherical holder of U.S. Pat. No. 8,888,391 has a two-piece exterior, with an upper portion and a lower portion. The lower portion contains a detachable interior piece—a wheel-shaped support platform, through which the lip balm is held in place. The lower portion is used as a grip when applying the lip balm.

These domed lip balm holders in the prior art are single-ended, having only one lip balm per product, and the lip balm is not releasable from or replaceable in the holder. The holder is not correctable or engageable with other lip balm holders.

Moreover, issues with commercially available domed lip balms have been extensively noted on Internet websites. Because of the shape of domed lip balms and the support platforms typically used to hold them, a large amount of the lip balm material is held below the support platform and thus is unusable by the consumer. This is exacerbated when the lip balm is accidentally exposed to excessive temperatures, such as leaving it in a hot car or sending it through a clothes dryer. Semisolid lip balms typically should be used and stored at temperatures lower than about 40° C., preferably below 30° C. If exposed to extremely high temperatures—temperatures above the melting point of the semisolid lip balm—the lip balm will become liquid. In domed lip balms with an open-type support mechanism, much of the lip balm problematically relocates to the bottommost area, where it is no longer usable without significant effort. Retrieval of unusable lip balm material has led consumers to disassemble the receptacle or re-melt the lip balm and transfer it to another holder so that the consumer can use it as a jar lip balm.

A need exists for a more usable domed lip balm product and its holder. It should be easy-to-use and comfortable, provide convenience and choice to the consumer, remain usable if inadvertently stored at excessively high temperatures, and be replaceable should it become unusable.

BRIEF SUMMARY OF THE INVENTION

It is an object of the invention to provide a lip balm applicator or holder that is releasably engageable with another lip balm applicator or holder that is equivalent to the first. Such a configuration provides a dual-ended lip balm container which allows choice to the consumer, facilitates ease of use by the consumer, and reduces cost in manufacturing by eliminating the need for a separate connecting unit and/or a differentiated base component.

It is another object of the invention to provide a lip balm applicator that stabilizes a lip balm filled into the applicator. This stability includes positional stability in a rotational direction, positional stability in a downward direction when inverted, as well as decreased loss of usable lip balm if accidentally exposed by the consumer to a temperature above the melting point of the lip balm composition.

It is another object of the invention to provide a lip balm applicator with engagement assemblies that are easy for the consumer to disengage and open, but that are rugged enough to remain engaged or unopened until the consumer desires. Another object provides differentiation of the engagement assemblies used in the lip balm applicator of the present invention to avoid disengaging one component when attempting to disengage another component, for example, accidentally disengaging two engaged bases when attempting to disengage the base and liner of one end.

It is another object of the invention to provide a lip balm applicator or lip balm container that is stable when laid on one of its sides and when stood upright or inverted so that the applicator or container does not roll away.

It is another object of the invention to provide a lip balm applicator or lip balm container that is comfortable in the consumer's hands and on the consumer's lips, providing rounded edges at specific internal or external locations, or both, while maintaining a proper number of sides, which facilitate opening the applicator or container.

It is another object of the invention to minimize costs for manufacturing a lip balm applicator, including minimizing the number of components in the lip balm applicator; minimizing the quantity of materials such as gap fillers used in a lip balm applicator; minimizing the types of material (e.g., different plastics) used to manufacture components of a lip balm applicator; and minimizing additional parts like lip balm molds and handles or grips to hold the lip balm applicator during use.

These and other objects of the invention are provided by a lip balm applicator, lip balm container, lip balm dispenser, lip balm mold, method of filling a lip balm mold, or method of manufacturing a domed lip balm described herein.

The invention provides a lip balm applicator that is releasably engageable with another lip balm applicator that is equivalent to the first. The lip balm applicator comprises a cap, a liner, and a base. The cap comprises a cap top with a cap flat edge and a cap top perimeter, a cap exterior, a cap interior having a lower cap interior and an upper cap interior, a first cap engagement assembly on the cap interior, and a cap bottom perimeter, wherein the cap has three to six sides.

The liner comprises a domed upper liner section, a lower liner section with a liner perimeter which contains a second cap engagement assembly which aligns with the first cap engagement assembly and engages the liner perimeter with the lower cap interior, a liner exterior, a liner interior having a lower liner interior and an upper liner interior, and a first liner engagement assembly on the lower liner interior.

The base comprises an upper base section having a base top edge, a lower base section, a partition dividing the upper base section and the lower base section and extending to a base perimeter which aligns with the cap bottom perimeter, the partition having a partition bottom and a partition top, with the partition top having an outer partition top section and an inner partition top section, an aperture in the partition, an upper base section exterior wall comprising a second liner engagement assembly which aligns with the first liner engagement assembly and engages the lower liner interior with the upper base section exterior wall, an upper base section interior wall, a plurality of stabilizers arising from a first area adjacent to the upper base section interior wall on the inner partition top section, rising to a level at or near horizontal with the base top edge and extending radially inward to a second area overhanging the aperture, a gap between each stabilizer and the upper base section interior wall, and a base engagement assembly on the lower base section which provides releasable engagement of a lower base section on the lip balm applicator with a lower base section on a second lip balm applicator, wherein the base has three to six sides and corresponds to the three to six sides of the cap. The maximum height of the stabilizers may be horizontally level with the base top edge; slightly below the height of the base top edge, e.g., within about 1 mm below, preferably within about 0.5 mm below, more preferably within about 0.2 mm below the height of the base top edge; or slightly above the height of the base top edge, e.g., within about 1 mm above, preferably within about 0.5 mm above, more preferably within about 0.2 mm above the height of the base top edge.

The lip balm applicator of the invention may further comprise a lip balm.

The invention provides a lip balm container comprising two lip balm applicators of the invention releasably engaged through the base engagement assembly on each lip balm applicator.

The invention provides a lip balm dispenser that is releasably engageable with another lip balm dispenser that is equivalent to the first. The lip balm dispenser comprises a liner and a base, the base having three to six sides. The lip balm dispenser of the invention may further comprise a lip balm.

The invention provides a lip balm dispenser that is releasably engageable with a lip balm applicator, the lip balm applicator having a base that is equivalent to the base of the lip balm dispenser. The bases of the lip balm applicator and the lip balm dispenser each have three to six sides. Either the lip balm dispenser or the lip balm applicator, or both, may further comprise a lip balm.

The invention provides a lip balm mold comprising a liner and a base, engaged via the first and second liner engagement assemblies and inverted such that the partition bottom is facing upward. The lip balm mold may further comprise a cap of the invention.

The invention provides a method for filling a lip balm mold comprising transferring a molten lip balm composition into a lip balm mold through an aperture in a partition to a fill level approaching the partition top but not touching the partition top. When the mold is filled to the fill level—slightly below the partition top—a pocket of air remains between the partition top and the upper surface of the molten lip balm composition. The thickness of the pocket of air will be about 0.5 mm, about 1 mm, about 1.5 mm, about 2 mm, about 2.5 mm, about 3 mm, about 3.5 mm, about 4 mm, about 4.5 mm, about 5 mm, about 5.5 mm, about 6 mm, about 6.5 mm, or about 7 mm, or a range between any two of these thicknesses.

The invention provides a method for manufacturing a domed lip balm comprising forming a molten lip balm composition, filling the molten lip balm composition into a lip balm mold through an aperture in a partition to a fill level approaching the partition but not touching the partition, and allowing the molten lip balm composition to cool to a temperature sufficient to congeal the lip balm composition.

BRIEF SUMMARY OF THE DRAWINGS

The invention described above and additional embodiments, objects, and advantages will be more evident from the following detailed explanations and with reference to illustrative embodiments in the accompanying drawings, wherein:

FIG. 1A is a perspective view of a lip balm container of the invention;

FIG. 1B is a perspective view of a lip balm applicator of the invention;

DETAILED DESCRIPTION OF THE INVENTION

Figure 2:
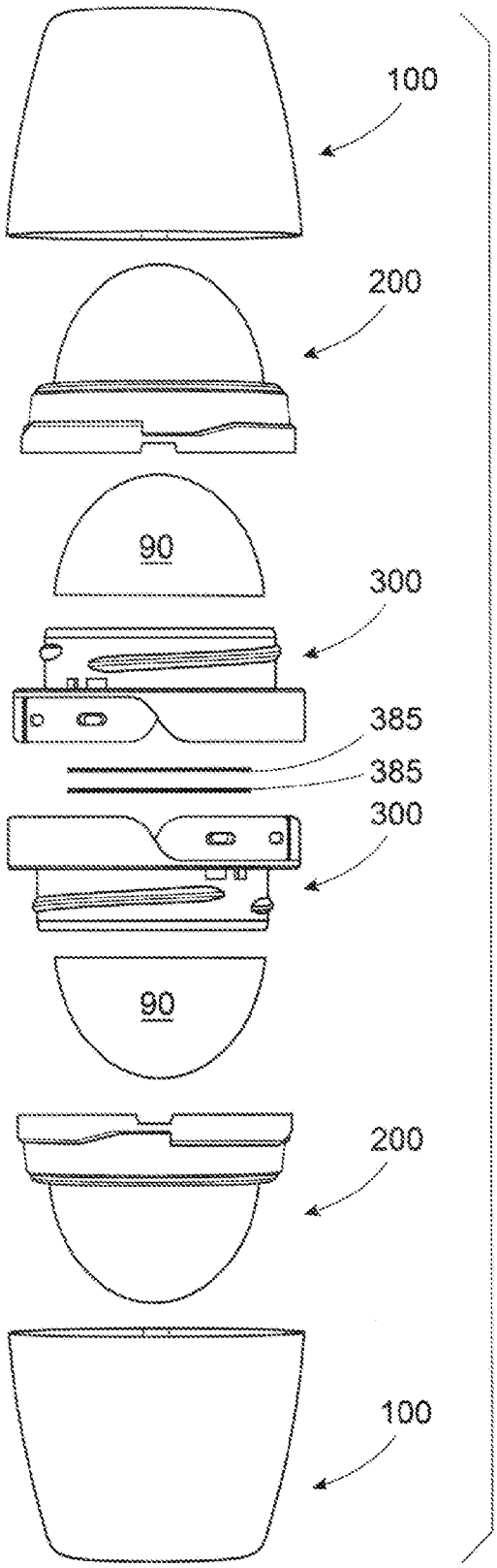
FIG. 2 is an exploded view of a lip balm container of the invention, with optional lip balms and optional coverings shown on both lip balm applicator ends of the dual-ended lip balm container.

A lip balm applicator 50 shown in FIG. 1B comprises a cap 100, a liner 200 (shown in FIG. 5) fully enclosed inside the cap 100, and a base 300. The lip balm applicator 50 has three to six sides 121.

Figure 3:
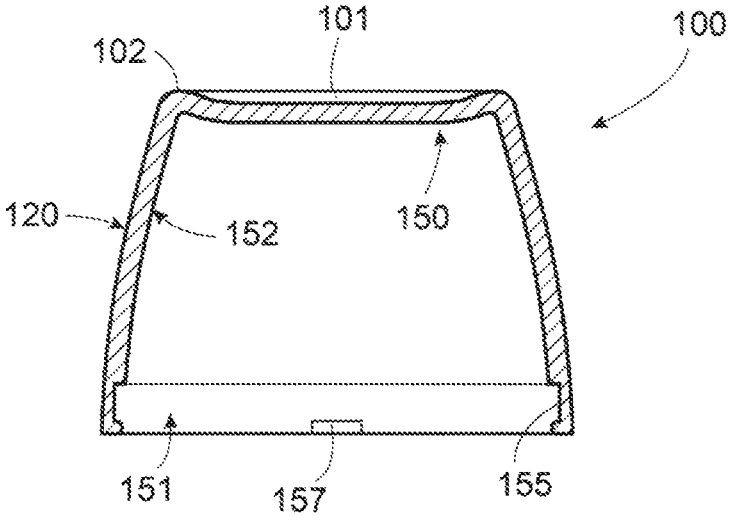
FIG. 3 is a sectional view of a cap of the invention.
Figure 4:
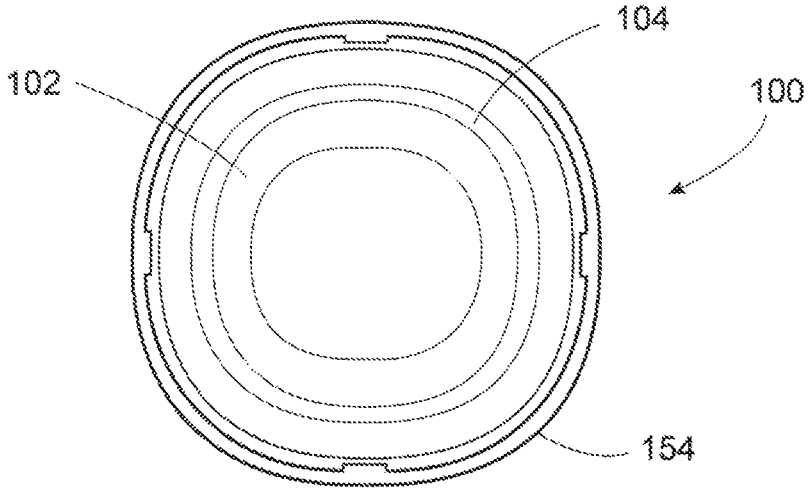
FIG. 4 is a bottom plan view of a cap of the invention.

The cap 100 shown in FIGS. 3 and 4 comprises a cap top 101 with a cap flat edge 102 and a cap top perimeter 104; a cap exterior 120; a cap interior 180 having a lower cap interior 151 and an upper cap interior 152; a first cap engagement assembly 155 on the lower cap interior 151; and a cap bottom perimeter 154. The cap 100 has three to six sides.

Figure 5:
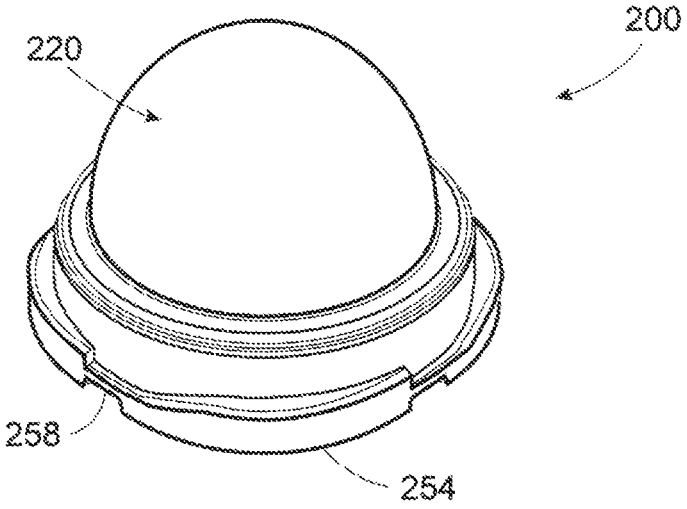
FIG. 5 is a perspective view of a liner of the invention.
Figure 6:
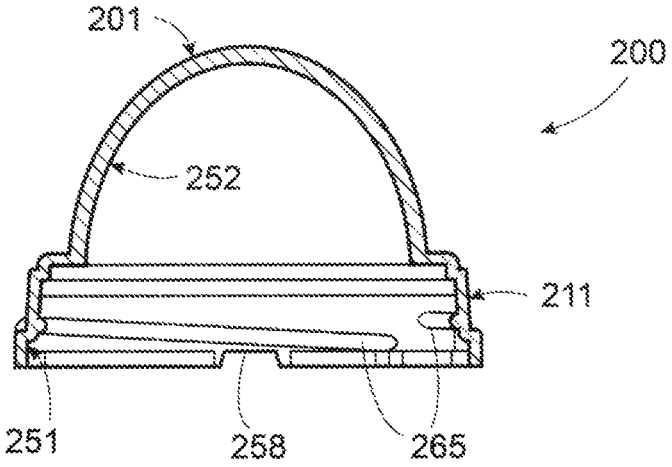
FIG. 6 is a sectional view of a liner of the invention.
Figure 7:
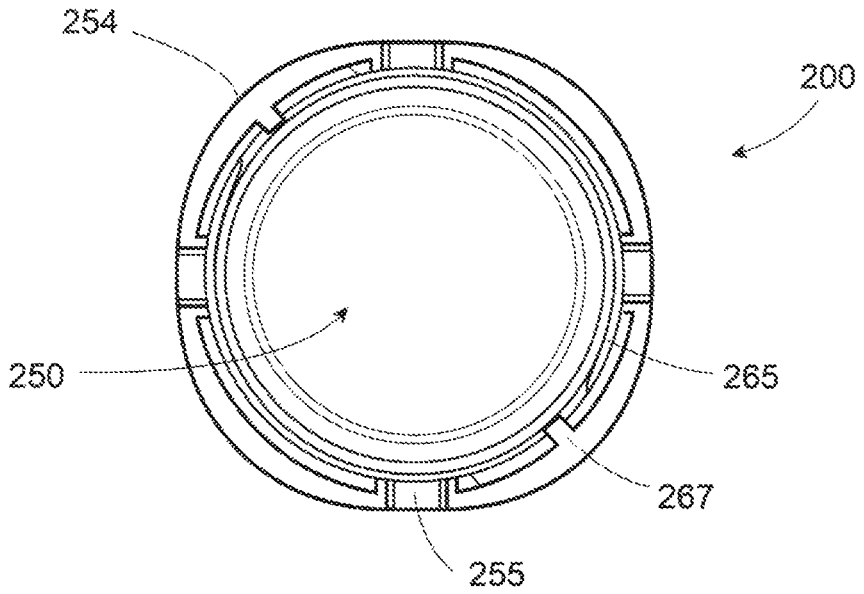
FIG. 7 is a bottom plan view of a liner of the invention.
Figure 8:
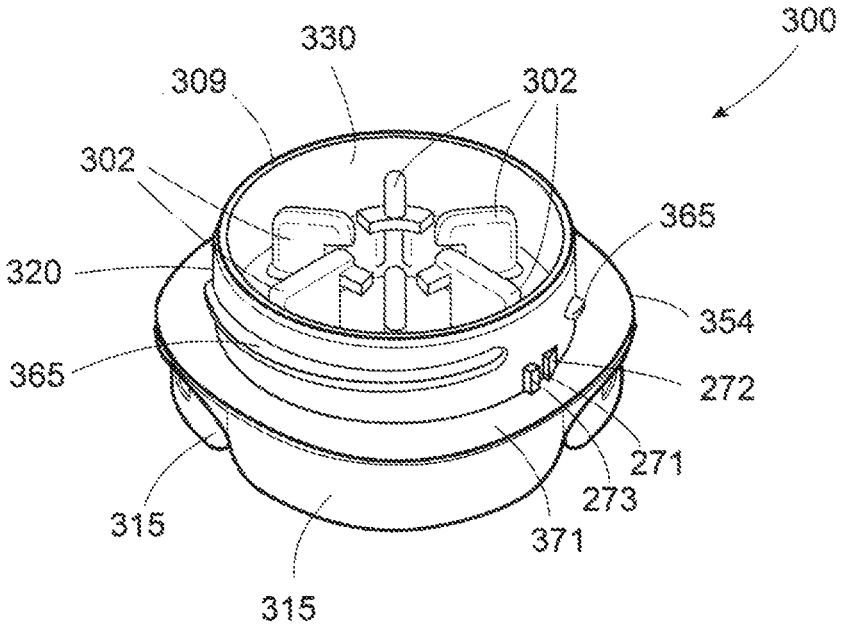
FIG. 8 is a perspective view of a base of the invention.
Figure 9:
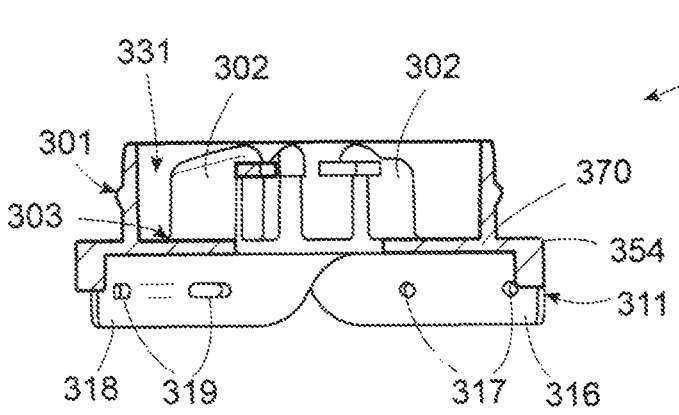
FIG. 9 is a sectional view of a base of the invention.

The liner 200 shown in FIGS. 5 to 7 comprises a domed upper liner section 201; a lower liner section 211 with a liner perimeter 254 which contains a second cap engagement assembly 255 which aligns with the first cap engagement assembly 155 (shown in FIG. 3) and engages the liner perimeter 254 with the lower cap interior 151 (shown in FIG. 3); a liner exterior 220; a liner interior 250 having a lower liner interior 251 and an upper liner interior 252; and a first liner engagement assembly 265 on the lower liner interior 251.

The base 300 shown in FIGS. 8 to 11 comprises an upper base section 301 having a base top edge 309; a lower base section 311; a partition 370 dividing the upper base section 301 and the lower base section 311 and extending to a base perimeter 354 which aligns with the cap bottom perimeter 154 (shown in FIG. 4), the partition 370 having a partition bottom 376 and a partition top 371, with the partition top 371 having an outer partition top section 372 and an inner partition top section 373; an aperture 380 centrally located in the partition 370; an upper base section exterior wall 320 comprising a second liner engagement assembly 365 which aligns with the first liner engagement assembly 265 (shown in FIG. 6) and engages the lower liner interior 251 (shown in FIG. 6) with the upper base section exterior wall 320; an upper base section interior wall 330; a plurality of stabilizers 302 arising from a first area 303 adjacent to the upper base section interior wall 330 on the inner partition top section 373, rising to a level at or near horizontal with the base top edge 309 and extending radially inward to a second area 306 overhanging the aperture 380; a gap 331 between each stabilizer 302 and the upper base section interior wall 330; and a base engagement assembly 315 on the lower base section 311 which provides releasable engagement of a lower base section 311 on the lip balm applicator 50 with a lower base section 311 on a second lip balm applicator 50. The base 300 has three to six sides.

The lip balm applicator 50 may have three sides, four sides, five sides, or six sides 121. These sides are formed by the three to six sides of the cap 100 aligning at the cap bottom perimeter 154 to meet the three to six sides of the base 300 at the base perimeter 354, the number of sides on the cap and base corresponding, to provide a lip balm applicator 50 having the same number of sides. As the number of sides 121 increase, the leverage for opening the lip balm applicator 50 decreases. The inventors believe that three to six sides 121 provides the consumer optimal leverage when opening the cap 100 and beneficial grip when using the lip balm applicator 50.

The sides 121 may be equivalent in size, i.e., a regular polygon such as a square, or may vary in size, e.g., rectangular. The lip balm applicator 50 is not tubular and is not substantially spherical or oval. Having defined sides 121 provides improved positional stability when laying the lip balm applicator 50 on its side 121; the propensity to roll is greatly decreased, if not eliminated.

In a preferred embodiment, the lip balm applicator 50 has four sides 121. In another preferred embodiment, the lip balm applicator 50 has four equivalent sides 121, i.e., the lip balm applicator 50 is square. In another preferred embodiment, the lip balm applicator 50 has four equivalent sides 121 with rounded edges, i.e., a rounded square. Having equivalent sides provides the advantage that the cap 100 aligns easily with the base 300 in multiple orientations; for example, when the lip balm applicator 50 has four equivalent sides 121, the cap 100 aligns with the base 300 in four different orientations. Any of these orientations will be equal, facilitating the consumer's placement of the cap 100 on the base 300.

In one embodiment, the sides 121 are flat surfaces. In another embodiment, the sides 121 are curved surfaces. The edges may be squared, rounded, chamfered, or otherwise angled. In a preferred embodiment, the sides 121 are minimally or slightly curved latitudinally with rounded edges. Having a slight curve on the sides 121 and rounded edges promotes a comfortable feel in the consumer's hands while maintaining positional stability when the lip balm applicator 50 is laid on one of its sides 121. In another preferred embodiment, the sides 121 are longitudinally curved outward such that the base perimeter 354 and the cap bottom perimeter 154, which align and thus are equal in size, are larger than the cap top perimeter 104.

The exterior surface of the sides 121 may be smooth, brushed, dimpled, textured, or any other relief. In a preferred embodiment, the texture of the exterior surface of the sides 121 is smooth.

A cap 100 of the present invention may be a component of a lip balm applicator 50, a lip balm container 60, or a lip balm mold of the invention. The cap 100 is manufactured as a single component. In one embodiment, the cap top 101 is flat. In a preferred embodiment, the cap top 101 is indented from the cap flat edge 102. An indented cap top 101, in combination with the cap flat edge 102 along the cap top perimeter 104, provides positional stability to the lip balm applicator 50 if it is placed in an upright position, i.e., standing on its cap 100 as opposed to lying on one of its sides 121.

A liner 200 of the present invention may be a component of a lip balm applicator 50, a lip balm container 60, a lip balm dispenser, or a lip balm mold of the invention. The liner 200 is manufactured as a single component.

A base 300 of the present invention may be a component of a lip balm applicator 50, a lip balm container 60, a lip balm dispenser, or a lip balm mold of the invention. Because the base 300 in this invention contains an integrated engagement assembly for engagement with another equivalent base, any need for a separate component for engagement is eliminated. The base 300 is manufactured as a single component, thereby reducing the cost of manufacturing. Single component manufacturing also improves quality, as only one set of tolerances is required for the base 300. Thus, no need exists for multiple base pieces, each having their own tolerances, to be assembled post-manufacture. Manufacturing is typically injection-molding, but other methods for manufacturing the base and other components of this invention are within the purview of the invention.

The integrated engagement assembly on each base 300 allows engagement of two corresponding lip balm applicators 50, two corresponding lip balm dispensers, or a lip balm applicator and a corresponding lip balm dispenser. Thus, the engagement assembly is intended to engage with an equivalent base 300 which is capable of holding a usable lip balm composition, and which equivalent base 300 optionally may comprise a lip balm 90.

The bases 300 are equivalent in configuration, as opposed to having two different but complementary configurations which must be paired appropriately. Having equivalent configuration allows the consumer to pair any two lip balm applicators 50 of the present invention together without confusion over which base configuration to select, as there is only one base configuration. Further, the releasability of the lip balm applicators 50 provides the consumer flexibility to replace the unit as needed or whenever desired plus the ability to mix or match lip balms 90 in the lip balm applicators 50 attached on opposing ends of a lip balm container 60.

The partition 370 of the base 300 is a flat surface which separates the upper base section 301 from the lower base section 311. The partition 370 extends completely across the base 300 from edge to edge, with the exception that an aperture 380 is located in the partition 370. A plurality of stabilizers 302 emerge out of the partition 370, beginning at a location near but without extending to the upper base section interior wall 330. Thus, a gap 331 exists between each stabilizer 302 and the upper base section interior wall 330 such that no stabilizer 302 touches the upper base section interior wall 330. When a liquid lip balm composition is filled into the lip balm applicator 50, the gap 331 between each stabilizer 302 and the upper base section interior wall 330 is filled with the lip balm composition to a certain level which is near but not touching the partition 370. An air pocket remains between the partition 370 and the lip balm composition, leaving a small section of the stabilizer 302 uncovered. That uncovered section includes the area where the stabilizer 302 arises from the partition 370. Because the stabilizers 302 do not reach the upper base section interior wall 330, a lip balm composition fills the gap 331 from the stabilizer 302 to the interior wall but does not touch the partition 370. The stabilizers 302 positionally stabilize the lip balm 90 in place.

In one embodiment, each stabilizer 302 rises to a maximum height that is horizontally level with the base top edge 300, such that if a flat surface were placed on the base top edge 300 to cover the entire edge, the highest level of each stabilizer 302 would touch that flat surface. In another embodiment, the maximum height of the stabilizers 302 is slightly below the height of the base top edge 300, e.g., within about 1 mm below, preferably within about 0.5 mm below, more preferably within about 0.2 mm below the height of the base top edge. In another embodiment, the maximum height of the stabilizers 302 is slightly above the height of the base top edge 300, e.g., within about 1 mm above, preferably within about 0.5 mm above, more preferably within about 0.2 mm above the height of the base top edge.

In one embodiment, the height of a stabilizer 302 is consistent across the length of the stabilizer. In another embodiment, the height of the stabilizer 302 varies across the length of the stabilizer. In another embodiment, the height of the stabilizer 302 is arched or curved across the length of the stabilizer. One or more of the stabilizers 302 may contain a small depressed area across the length of the stabilizer where the injection gate occurs during injection-molding. In a preferred embodiment, the top edge of the stabilizer 302 slants gradually upward from a shortest height at the end closest to the upper base section interior wall 330 to the tallest height at the end projecting over the aperture 380.

Each stabilizer 302 extends radially inward toward the center of the partition 370 and terminates at a position extending over the aperture 380. To achieve this overhang, the stabilizer 302 top section is longer than the stabilizer 302 bottom section. The shape of the stabilizer 302 which achieves this difference in length may vary, for example, being a constant angle over the entire height, i.e., wedge shaped, or alternatively, having a consistent length up to a specific height with an extended length for the remainder. In a preferred embodiment, the length of the bottom section of the stabilizer 302 extends to the edge of the aperture 380, and the stabilizer rises about 4 mm to about 5 mm upward in height at a consistent length of about 5 mm to about 6 mm, to a height that is about 2 mm to about 3 mm from the top edge of the stabilizer 302, at which point the stabilizer extends to a longer length, extending by about 1.5 mm to about 3 mm, so that the stabilizer projects over the aperture 380.

The length of each of the stabilizers 302 may be the same, or they may vary in length. In one embodiment, all stabilizers 302 are about the same length. In another embodiment the stabilizers 302 vary in length, depending on location around the aperture 380. This variation in length is especially important if the aperture 380 is oval, rectangular, or another shape.

In one embodiment, each stabilizer 302 contains a vertical blade. The vertical blade is a solid, substantially flat surface with a width that is about one-fifth to about one-half of the shortest length of the blade. Preferably, the width of the vertical blade is about 1.2 mm to about 2.5 mm, more preferably about 1.5 mm to about 2 mm. The top edge of the blade may be rounded, chamfered, or otherwise beveled to avoid rough edges, improving manufacturability of the blade and providing physical stability to a composition such as lip balm 90 which may envelop the blade edge. Beveling also provides a smoother edge in case the consumer's lip contacts the blade edge when using the lip balm applicator 50, e.g., if the lip balm 90 level is near an unusable level.

Figure 10:
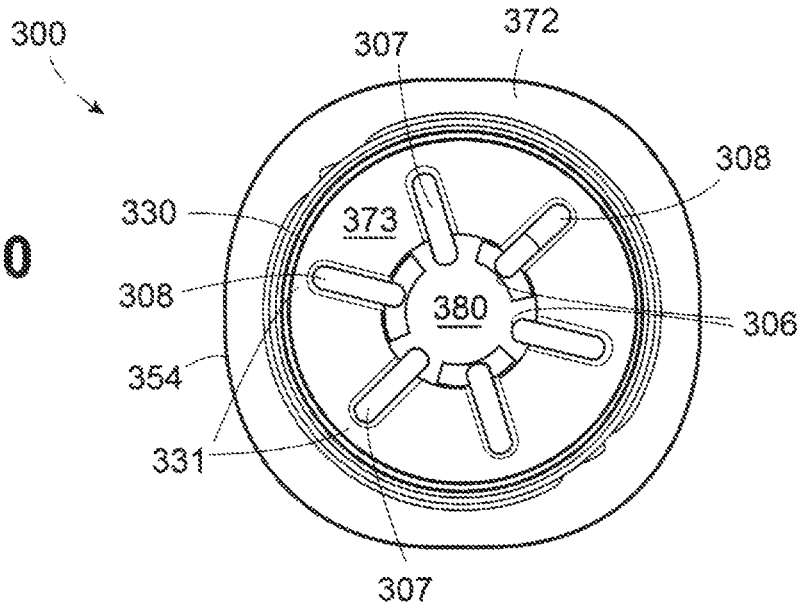
FIG. 10 is a top plan view of a base of the invention.
Figure 11:
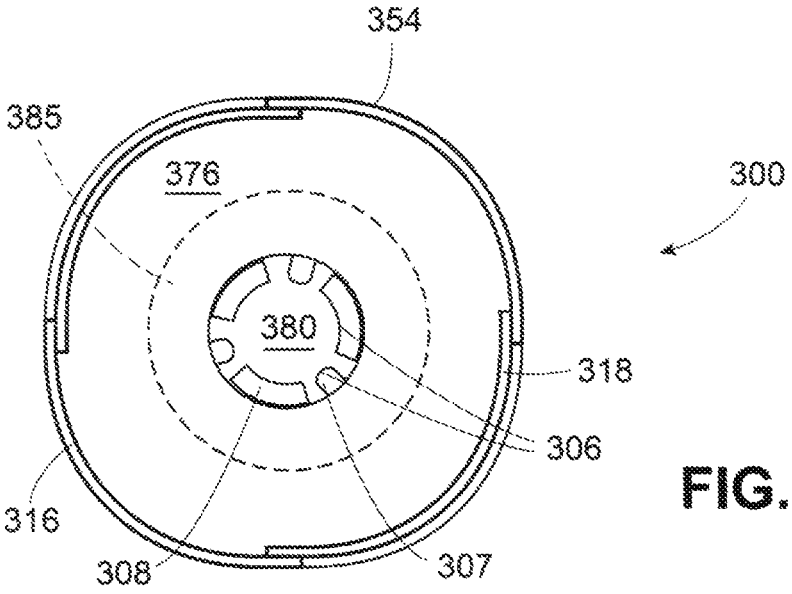
FIG. 11 is a bottom plan view of a base of the invention.

In one embodiment, at least one stabilizer 302 is a vertical blade having a horizontal fin 308 (shown in FIG. 10). The vertical blade is similar to that described above, except that the extended section which overhangs the aperture 380 has a flat, horizontal fin or wing molded into the extended section. In one embodiment, the horizontal fin is molded into the bottom section of the extended section, the horizontal fin preferably rising to a height that is about one-third to about one-half of the height of the extended section. Preferably, the horizontal fin is curved lengthwise to match the curvature, if any, of the aperture 380 over which it hangs.

In another embodiment, the plurality of stabilizers 302 consists of a combination of vertical blades 307 and vertical blades with horizontal fins 308. Preferably, the plurality of stabilizers 302 consists of an even number of stabilizers 302, alternating between a vertical blade 307 and a vertical blade with a horizontal fin 308. Alternating the type of stabilizer 302 provides increased positional stability for a lip balm 90 in the lip balm applicator 50 because this configuration increases the number of stabilizers 302 having both vertical and horizontal stability which can be placed in a given circumference. The vertical sections of the stabilizers 302 provide horizontal stability such that the lip balm 90 resists rotation. The horizontal sections of the stabilizers 302 provide vertical stability so that the lip balm 90 resists vertical movement such as falling out of the partition 370 when inverted.

The number of stabilizers 302 to be included is determined by the size of the base 300 and the type of stabilizer 302 used. For example, if vertical blades with horizontal fins 308 are not included, more vertical blades 307 can be used. If only vertical blades with horizontal fins 308 are included, fewer blades will fit within the confined area. A typical number of stabilizers 302 will be two, three, four, five, six, seven, eight, nine, or ten, but more or less can be used. In a preferred embodiment, six stabilizers 302 are included. Most preferably, three vertical blades 307 and three vertical blades with horizontal fins 308 are used, configured alternatingly, i.e., a vertical blade 307 positioned adjacent to a vertical blade with a horizontal fin 308, repeated two more times, for six total stabilizers 302.

The base 300 specifically does not comprise a detachable structure for holding a lip balm composition. The plurality of stabilizers 302 integrated into the base 300 of the present invention, which provide positional stability for any lip balm composition present in the lip balm applicator, is not detachable from the base 300.

The type of engagement assemblies used for the cap engagement assembly, liner engagement assembly, or base engagement assembly 315 may be any type of engagement assembly. Illustrative engagement assemblies include, but are not limited to, a friction-fit, which is also called press-fit, press-on fit, or interference-fit; a welding fit such as a sonic or ultrasonic weld, spin weld, vibration weld, hot plate weld, or laser weld; an adhesion bond; riveting; a snap-fit, comprising engagement assemblies such as posts and slits, bumps and holes, and the like; or a screw-fit or any fit involving the inter-engagement of threads. To provide for engagement of bases 300 of the present invention, the base engagement assembles 315 must be equivalent on both bases 300, not complementary.

In one embodiment, the liner engagement assembly may provide the same type of engageability as the base engagement assembly 315. In another embodiment, the liner engagement assembly provides an alternative type of engageability from the base engagement assembly 315. For example, the base engagement assembly 315 may be a friction-fit engagement when the liner engagement assembly is a screw-on engagement, said screw-on engaging through the engagement of threads on the liner 200 and base 300. As another example, the base engagement assembly 315 may be a snap-fit engagement through the engagement of bumps and holes when the liner engagement assembly is a friction-fit engagement between the liner 200 and base 300. Having two different types of engageability reduces the risk of disengaging the liner engagement assembly when attempting to disengage the base engagement assembly 315, or the opposite—namely, disengaging the base engagement assembly 315 when attempting to disengage the liner engagement assembly.

In one embodiment, the base engagement assembly 315 is a snap-fit. In a preferred embodiment, the snap-fit consists of at least one tab having at least one bump 316 (shown in FIG. 9) and at least one tab having at least one hole 318 (shown in FIG. 9), wherein the at least one bump 317 (shown in FIG. 9) on a first base 300 aligns with the at least one hole 319 (shown in FIG. 9) on a second base 300. The hole 319 is slightly elongated so that it is wide enough to allow the bump 317 on the corresponding base 300 to easily enter the hole 319, to facilitate attachment by the consumer. Yet, the hole 319 is not so wide as to allow the bump 317 to slide out of the hole 310 without a small force being applied. Requiring a small force for disengagement ensures that two bases 300 remain engaged until such time that the consumer desires to disengage them, thereby decreasing the risk of disengagement in the consumer's pocket or handbag. The locations of the bumps 317 and holes 319 are optimized on the tabs to provide the most effective release from the base mold during manufacturing as well as providing optimum flexibility for ease of releasability by the consumer.

In another preferred embodiment, the snap-fit base engagement assembly 315 consists of two tabs having at least one bump 316 each and two additional tabs having at least one hole 318 each. In another preferred embodiment, the snap-fit consists of two tabs having at least one bump 316, and each of those tabs have two bumps 317, and the snap-fit further consists of two additional tabs having at least one hole 318, and each of those additional tabs have two boles 319. For clarity, this preferred snap-fit consists of four tabs: two tabs each having two bumps 317 and two additional tabs each having two holes 318. In another preferred embodiment, the snap-fit with four tabs has alternating tabs: one tab with at least one bump 317, adjacent to a tab with at least one hole 318, adjacent to anther tab with at least one bump 317, adjacent to another tab with at least one hole 318.

In one embodiment, the first liner engagement assembly 265 and the second liner engagement assembly 365 form a screw-fit. In this embodiment, the upper base section exterior wall 320 and the lower liner interior 251 must be circular. In a preferred embodiment, the first liner engagement assembly 265 and the second liner engagement assembly 365 are complementary inclined planes which form a screw-fit. The choice of liner engagement assembly is especially important if a lip balm 90 is present in the lip balm applicator 50. A screw-fit engagement assembly is a complex engagement which requires sufficient force plus rotation to open. This is an advantageous engagement for protecting a lip balm 90 from accidental opening of the engagement assembly. In a preferred embodiment, a screw-fit liner engagement assembly is used which provides 180 degrees of rotation for engagement of the liner 200 to the base 300. This is advantageous over other engagement types, which often require 360 degrees of rotation or others which have no rotational stops.

In another embodiment, the upper base section exterior wall 320 comprises at least one ramp 272, at least one hollow 271, and at least one chock 273; and the lower liner interior 251 comprises at least one pin 267. In this embodiment, the at least one pin 267 aligns with the at least one hollow 271 and the at least one chock 273 stops the liner 200 from rotating. In a preferred embodiment, the upper base section exterior wall 320 comprises two ramps 272, two hollows 271, and two chocks 273; the lower liner interior 251 comprises two pins 267, and each pin 267 aligns with a hollow 271, and each chock 273 stops the liner 200 from rotating.

In one embodiment, the first cap engagement assembly 155 and the second cap engagement assembly 255 form a snap-fit. In a preferred embodiment, the first cap engagement assembly 155 comprises at least one tooth 157 (shown in FIG. 3) on the lower cap interior 151 and the second cap engagement assembly 255 comprises at least one notch 258 (shown in FIG. 6) on the liner perimeter 254, and the at least one tooth 157 and the at least one notch 258 align to form the snap-fit. In another preferred embodiment, the first cap engagement assembly 155 comprises four teeth 157 on the lower cap interior 151 and the second cap engagement assembly 255 comprises four notches 258 on the liner perimeter 254, and each tooth 157 aligns with each notch 258 to form the snap-fit. Preferably, the cap 100 and liner 200 maintain their engagement permanently after the initial engagement is made.

The cap 100, the liner 200, or the base 300, each independently or in any combination, may be transparent, translucent, or opaque. Each may contain a solid color, including white or black, or a combination of colors in any pattern, or may be colorless.

In one embodiment of a lip balm applicator 50 of the invention, the cap 100 or the liner 200 is transparent. In another embodiment, the cap 100 and the liner 200 are transparent. In another embodiment, the liner 200 is transparent and colorless, the cap 100 is transparent and colored, and the base 300 is colored and opaque. Because the liner 200 and the cap 100 are individual components, this color and clarity combination allows a lip balm 90 which may be included in the applicator 50 to be visible from outside the applicator 50. This is advantageous in that it allows the consumer to inspect the lip balm 90 prior to purchase. If the lip balm 90 contains a colorant or other visual modifier, the consumer will be better able to visualize the lip balm 90. The cap 100 color may also be matched to any colorant or flavorant that is included in the lip balm 90, e.g., a purple cap 100 may indicate a grape flavor.

Additional advantages provided by the two-component cap 100 and liner 200 system is that less material is used in the manufacture of the components. The liner 200 and the cap 100 only touch in the location of the first cap engagement assembly 155 and the second cap engagement assembly 255; thus, an air gap exists between the liner exterior 220 and the upper cap interior 152. No filler material is used in the air gap, which also causes the lip balm applicator 50 to weigh less than if a filler material were included or if the cap 100 and liner 200 were a single component.

The aperture 380 in the partition 370 is included to provide an opening through which a composition such as a lip balm 90 may be filled into the lip balm applicator 50 or components thereof, e.g., a liner 200 and a base 300 which are engaged. The aperture 380 may be any size that is sufficient to allow a composition to be transferred through it. However, it is advantageous to minimize the aperture 380, to keep contaminants from entering the aperture 380 which would contaminate a composition used in the lip balm applicator 50. The aperture 380 may be any shape and may be in any location on the partition 370. In one embodiment, the aperture 380 is circular. In another embodiment, the aperture 380 is centrally located in the partition 370. Preferably, the aperture 380 is a circular hole centrally located in the partition 370.

The aperture 380 may be covered, especially after a lip balm 90 composition is filled into the lip balm applicator 50 or components thereof. The covering 385 may be any size or shape so long as the covering 385 fulfills the intended purpose of closing the aperture 380. To minimize costs associated with a covering 385, the size and shape of the covering 385 should be the same or similar in shape to the shape of the aperture 380, with a size slightly larger than the aperture 380 but sufficiently large to remain in place to cover the aperture 380. The covering 385 may be composed of any material, including but not limited to paper, cardboard, or other celluloses; vinyls, nitrites, polyethylene, polypropylene, or other plastics; cotton, leather, polyester, nylon, or other fabrics; gelatin, keratin, or other proteins; chitosan; chitin; alginate or other polysaccharides or sugars; rubber; gum; glass or ceramic; wax; foil or other metals; or any other suitable material, or a combination thereof. The covering 385 may be natural or synthetic or a combination. Preferably, the material of the covering 385 does not chemically interact with any composition filled into the lip balm applicator 50 or components thereof, in case the material would come into physical contact with the composition at any time. The covering 385 may be adhered or attached to the partition 370 by any suitable means, including adhesive, heat sealing, fastening, stamping, crimping, insertion through the aperture 380, and the like. In one embodiment, the covering 385 is paper. In another embodiment, the covering 385 is a metallic foil. In another embodiment, the covering 385 is a plastic. In a preferred embodiment, the covering 385 is polypropylene. In another preferred embodiment, the covering 385 is a polypropylene film cover which is slightly larger than the aperture 380 and which cover is attached to the partition bottom 376 via a food grade adhesive.

The lip balm applicator 50 of the invention may further comprise a lip balm 90 as shown in FIG. 2. The lip balm 90 is a semisolid. In a preferred embodiment, the lip balm of the invention is a semisolid with a melting point above 45° C. More preferably, the lip balm is a semisolid with a melting point above 50° C. Most preferably, the lip balm is a semisolid with a melting point at or above 52° C. Lip balms of the present invention should be stored at a temperature below about 40° C., more preferably below about 35° C. more preferably below about 30° C., and most preferably at or below about 25° C. Lip balms of the present invention should also be kept from exposure to excessive heat and should not be stored in the direct sun. By taking such precautions, the consumer may avoid liquefying the semisolid lip balm.

A major concern with semisolid lip balms is accidental exposure to extremely high temperatures under which the semisolid liquefies. Depending on the melting point of the lip balm, melting may occur if the lip balm is stored in an extremely hot location, such as a car during hot weather, or otherwise exposed to excessive temperatures, such as temperatures in a clothes dryer. In this case, the semisolid melts and relocates to the bottommost position of its receptacle. When the temperature drops, the lip balm congeals in place. Depending on the type of receptacle and its positional orientation (e.g., upright, inverted, tilted, etc.) during this cycle, the lip balm may re-congeal in a location which is below the usable surface for the lip balm.

If this melt and re-congeal cycle occurs in the lip balm applicator 50 of the present invention, the lip balm 90 is mostly contained at a usable level in the lip balm applicator. However, lip balm receptacles that are not configured like the lip balm applicator 50 of the present invention may not prevent relocation of the lip balm under heated temperatures. If the lip balm melts in an upright or tilted orientation, the lip balm pools in the bottommost section of the receptacle. Any section that is below the support platform is not reachable by the consumer, and thus is not usable even after it re-solidifies. The receptacle must be disassembled in order to remove the lip balm, or the lip balm must be re-melted.

A lip balm 90 of the present invention may comprise at least one ingredient selected from the group consisting of moisturizing agents, flavorants, sweeteners, colorants, medicaments, sunscreens, taste-masking agents, sensates, antioxidants, preservatives, and combinations thereof.

The lip balm 90 of the present invention may comprise at least one moisturizing agent such as an occlusive, emollient, humectant, or a combination thereof. Illustrative moisturizers include, but are not limited to, petrolatum; lanolin and lanolin derivatives; cetyl alcohol, stearyl alcohol, oleyl alcohol; plant oils such as seed oils; mineral oils; butters such as botanical butters; waxes such as beeswax, carnauba, candelilla, paraffin, white wax, or microcrystalline wax; ozokerite; glycerin; propylene glycol; urea; alpha-hydroxy acids such as lactic acid; jojoba esters; ceramide; collagen, keratin, elastin; or combinations thereof.

The lip balm may contain at least one flavorant, which may be a single flavor or a combination of flavors. The flavorant may be derived from natural products, synthesized flavorants, or combinations thereof. Flavorants are typically used in amounts of about 0.1% to 5%.

Optionally, sweeteners such as sucralose, saccharin, aspartame, stevia, or combinations thereof, may be included in the lip balm 90, generally in amounts of about 0.01% to about 0.1%.

One or more colorant may be included in the lip balm 90. Colorants may include, for example, plant extracts, natural minerals, including micas or oxides, or carmine.

The lip balm 90 may comprise a medicament including, but not limited to, menthol, camphor, eucalyptus, salicylic acid, derivatives of salicylic acid, allantoin, benzocaine, phenol, and pramoxine, or combinations thereof. In some embodiments, petrolatum or dimethicone or both may also provide medicament benefits. The above list is not an exhaustive list of medicaments, and those of skill in the art may consider the use of other medicaments. Typically, medicaments which are added for medicament purposes only will be added in amounts of less than about 3%. Amounts may vary depending on the potency of the medicament and the matrix in which the medicament is presented.

One or more sunscreens may be included in the lip balm 90 to protect lips from UVA radiation, UVB radiation, or both. Representative organic sunscreens include, but are not limited to, aminobenzoic acid, avobenzone, cinoxate, homosalate, meradimate, octocrylene, oxybenzone, octinoxate, octisalate, padimate O, ensuilzole, sulisobenzone, and trolamine salicylate; and representative inorganic sunscreens include, but are not limited to, zinc oxide and titanium dioxide.

At least one taste-masking agent, such as a spider ester, may be included in the lip balm 90.

A sensate is a composition that initiates a sensory perception such as heating or cooling, for example, when contacted with the skin and/or lips. Illustrative sensates which may be included in the lip balm 90 include mint extracts, cinnamon extract, and capsaicin.

Antioxidants may protect the lip balm 90 from oxidation (e.g., becoming rancid) and/or provide lip conditioning benefits upon application to the lips such as reducing the appearance of aging and at least temporarily making fine lines and/or wrinkles less visible. Representative antioxidants include tocopherols, tocopheryl acetate, coenzyme Q10 (ubiquinone), hyaluronic acid, hyaluronate salts and derivatives of hyaluronic acid, spilanthes flower, some botanical butters and green tea extracts. Antioxidants in the lip balm 90 are typically less than about 3%, alternatively less than about 2%, and alternatively less than about 1%.

A preservative may be added to provide antibacterial protection. Suitable preservatives may include parabens, mixtures of parabens, imidazolidinyl urea, diazolidinyl urea, and mixtures thereof, or other preservatives known in the art. The total amount of preservative is preferably less than 1%, alternatively less than 0.5%, and alternatively less than 0.2%.

The invention provides a lip balm container 60 shown in FIG. 1A consisting of two lip balm applicators 50 of the invention engaged through the base engagement assembly 315 on each lip balm applicator 50. The lip balm applicators 50 comprising the lip balm container 60 may be any embodiment or arrangement described herein.

In a preferred embodiment, the lip balm container 60 consists of two lip balm applicators 50, each having four equivalent sides 121 which are slightly curved latitudinally with rounded edges, which sides 121 are longitudinally curved outward such that the base perimeter 354 is slightly larger than the cap top perimeter 104, with cap top 101 that is indented from the cap flat edge 102, and a base 300 having a snap-fit base engagement assembly 315 consisting of two tabs having two bumps 316 each and two additional tabs having two holes 318 each. This preferred lip balm container 60 is barrel-shaped.

When the snap-fit base engagement assembly 315 consists of two tabs having two bumps 316 each and two additional tabs having two holes 318 each, the technique for disengaging the two equivalent bases 300 requires bending of the two components in a downward motion. The movement is similar to that used when pulling apart two ends of a cracked egg and keeping sections of the egg in each half of the eggshell. Here, each end is rotated in an opposite direction; the right end is rotated clockwise, and the left end is rotated counterclockwise, with the two tops being rotated toward each other until both face downward. This differs from a disengagement technique where the two ends are pulled apart in opposite directions in a straight line. The requirement for rotational bending provides a more deliberate way of disengaging the two lip balm applicators 50 than is required with some other engagement assemblies.

Because the lip balm container 60 consists of two lip balm applicators 50, it is dual-ended. In this configuration, the consumer typically uses one lip balm applicator 50 at a time, leaving the opposing lip balm applicator 50 closed or covered, i.e., with the cap 100 and liner 280 engaged to the base 300. This closed lip balm applicator 50 may serve as a handle for using the lip balm applicator 50 that is open. No additional component for holding the lip balm applicator 50 is needed, thereby reducing production costs.

The invention provides a lip balm dispenser comprising a liner and a base 300 of the present invention as described herein. The base 300 of the lip balm dispenser has three to six sides. The liner and base 3008 may be any embodiment or arrangement described herein. The lip balm dispenser may optionally have a lip balm 90 or a covering 385, or both. The lip balm dispenser may be cap-less or may be encased by any structure, except that it may not be encased by a cap 100 of the invention. Given that the lip balm dispenser does not comprise a cap 100 of the invention, the liner may have a cap engagement assembly like the second cap engagement assembly 255 of the liner 200 described for the lip balm applicator; however, it is not a required element for the liner of the lip balm dispenser. All other elements of the liner for the lip balm dispenser are the same as for the liner 200 of the lip balm applicator. For clarity, a liner of a lip balm dispenser described herein comprises a domed upper liner section 201; a lower liner section 211 with a liner perimeter 254; a liner exterior 220; a liner interior 250 having a lower liner interior 251 and an upper liner interior 252; and a first liner engagement assembly 265 on the lower liner interior 251; optionally, it may further have a cap engagement assembly like the second cap engagement assembly 255 or any other cap engagement assembly.

The lip balm 90 is a composition in a semisolid physical state. It may be prepared as a molten liquid mixture and transferred into a mold to form a domed shape lip balm 90 as the molten mixture cools to a semisolid state.

The invention provides a lip balm mold comprising a liner and a base 300 of the present invention, engaged via the first and second liner engagement assemblies 365 and inverted such that the partition bottom 376 is facing upward and the liner points downward. In another embodiment, the lip balm mold further comprises a cap 100 of the invention. Thus, the mold into which the molten liquid mixture is transferred to form a domed lip balm 90 once cooled may be the entire lip balm applicator 50 or alternatively, the liner and base 300, which are components of the lip balm applicator 50 of the present invention. However, like the lip balm dispenser described above, the liner of the lip balm mold may have a cap engagement assembly like the second cap engagement assembly 255 of the liner 200 described above, but it is not a required element for the liner of the lip balm mold. All other elements of the liner for the lip balm mold are the same as for the liner 200 of the lip balm applicator. For clarity, a liner of a lip balm mold described herein comprises a domed upper liner section 201; a lower liner section 211 with a liner perimeter 254; a liner exterior 220; a liner interior 250 having a lower liner inferior 251 and an upper liner interior 252; and a first liner engagement assembly 265 on the lower liner interior 251; optionally, it may further have a cap engagement assembly like the second cap engagement assembly 255 or any other cap engagement assembly.

The invention provides a method for filling a lip balm mold comprising transferring a molten lip balm composition into a lip balm mold through the aperture 380 in the partition 370 to a fill level approaching the partition top 371 out not touching the partition top 371. Note that in the inverted position used for filling the mold, the partition top 371 faces downward and the stabilizers 302 emerge out of the partition top 371 and point vertically downward. Filling slightly below the partition top 371, a pocket of air remains between the partition top 371 and the upper surface of the molten lip balm composition such that the position where each stabilizer 302 emerges from the partition top 371 is not immersed in or enveloped by the lip balm composition; lip balm 90 is not present at the point at which the stabilizer 302 emerges out of the partition top 371. Typically, the thickness of the pocket of air will be about 0.5 mm, about 1 mm, about 1.5 mm, about 2 mm, about 2.5 mm, about 3 mm, about 3.5 mm, about 4 mm, about 4.5 mm, about 5 mm, about 5.5 mm, about 6 mm, about 6.5 mm, or about 7 mm, or a range between any two of these thicknesses. In a preferred embodiment, this pocket of air is about 1 mm to about 5 mm thick. More preferably, this pocket of air is about 1.5 mm to about 4 mm thick.

Because the liner serves as the filling reservoir, no additional mold is needed, reducing manufacturing costs. Further, no additional steps are needed to remove the lip balm 90 from a filling mold and to place it into the lip balm applicator 50.

The invention provides a method for manufacturing a domed lip balm 90 comprising forming a molten composition of the lip balm 90. The molten composition is filled into a domed lip balm mold through the aperture 380 in the partition 370 to a fill level approaching the partition top 371 but not touching the partition top 371, and then cooled to a temperature sufficient to form a domed lip balm 90. As above, filling slightly below the partition top 371, a pocket of air remains between the partition top 371 and the upper surface of the molten lip balm composition such that the position where each stabilizer 302 emerges from the partition top 371 is not immersed in or enveloped by the lip balm composition; lip balm 90 is not present at the point at which the stabilizer 302 emerges out of the partition top 371. Typically, the thickness of the pocket of air will be about 0.5 mm, about 1 mm, about 1.5 mm, about 2 mm, about 2.5 mm, about 3 mm, about 3.5 mm, about 4 mm, about 4.5 mm, about 5 mm, about 5.5 mm, about 6 mm, about 6.5 mm, or about 7 mm, or a range between any two of these thicknesses. In a preferred embodiment, this pocket of air is about 1 mm to about 5 mm thick. More preferably, this pocket of air is about 1.5 mm to about 4 mm thick. The domed lip balm 90 should be a semisolid at temperatures that are warmer than human body temperature. The molten composition may be allowed to cool gradually at ambient temperatures or expressly cooled by refrigeration, shock cooling, or any other cooling technique.

Using the methods of the present invention for filling a lip balm mold and manufacturing a domed lip balm 90, wasting of lip balm is decreased because the fill does not touch or extend through the partition top 371. This is advantageous for consumers, as other domed lip balm holders are not configured to avoid this waste.

"Domed" means curved or rounded. A domed object may be shaped like a hemisphere, but the term "domed" is not limited to a spherical surface; for example, it may also be ovoid or ellipsoidal.

A "blade" is a thin, flat, solid piece of material.

"Rounded" means curved or filleted, not angular. A "rounded square" has four sides of equal length that are at 90 degree angles from each other, having corners that are smoothed by curves such that the 90 degree angle between sides occurs over an arc as opposed to an abrupt turn.

"Side" refers to the outermost, vertical section of the cap 100, base 300, lip balm applicator 50, or lip balm container 60 when placed in an upright position. Sides 121 are joined together at "edges," which are the corners where two sides 121 meet. For clarity, side 121 does not refer to the top, i.e., the cap top 101, nor does it refer to the bottom of the lip balm applicator 50, lip balm container 60, or base 308. Thus, "four-sided," "square," or "rounded square" refers to the two-dimensional view looking downward at the cap top 101; the top and the bottom are not sides.

"Longitudinally" means lengthwise, from top to bottom. "Latitudinally" means crosswise, from side to side.

"Alternatingly" means occurring in an alternating pattern; interchanging repeatedly one for another.

"Positional stability" means that an object has a propensity to maintain the location and orientation in which it is placed.

"Complementary" refers to objects which differ in configuration but combine to form a completed unit, e.g., counterparts.

As used herein, "equivalent" means that the required components have the same general shape or configuration, but optional components may be different. Additionally, attributes such as color, clarity, texture, sizes such as length, width, thickness, etc. of interior components, may be different between two equivalent items. For example, two equivalent lip balm applicators will each have a cap, a liner, and a base as described herein, but one may have an optional lip balm and covering with a transparent purple cap, a transparent pink liner, and a translucent blue base, and the other may have no lip balm or covering with a transparent colorless cap, a transparent yellow liner and an opaque white base. In this example, the attributes and optional components of the lip balm applicators vary, but the required components are the same; thus, the lip balm applicators are equivalent.

For the present invention, the term "barrel-shaped" means shaped like a barrel, i.e., being generally cylindrical in shape, except that the top and bottom are not circular but instead are polygonal with three to six sides, the sides are slightly curved to appear bulging in the longitudinal center, each individual side is minimally curved latitudinally toward the rounded edges that the side shares with the adjacent two sides, and the top and bottom of the barrel shape are parallel to each other and have flat edges around the perimeter.

A "chock" is a block or stop, against which an object is placed to prevent the object from moving forward.

"Semisolid" refers to the physical state of the substance in the temperature range of about 20° C. to about 40° C. A semisolid is not pourable at ambient temperatures, and it does not flow or conform to the shape of a receptacle at such temperatures. Semisolid dosage forms have a soft solid consistency. To avoid melting of a semisolid, precautions should be taken to avoid using, storing, and/or exposing the semisolid to excessive temperatures, especially temperatures above the melting point of the semisolid.

A "lip balm" is a semisolid composition for application to the lips that has protective or moisturizing properties, or both. A "domed lip balm" is a lip balm formed into a domed shape that is typically dispensed directly from the holder without refraction of the lip balm back into the holder. The domed shape of the lip balm allows for easy delivery of the lip balm to the lips. A domed lip balm is broader than a stick lip balm product, and thus requires less accuracy when administering.

A "butter" or "botanical butter" is a semisolid extract of a plant fruit and/or seed characterized by having emollient properties and a melting point near human body temperature.

The term "petrolatum" refers to petroleum jelly, which is a mixture of the softer members of the paraffin or methane series of hydrocarbons obtained from petroleum as an intermediate product in the distillation. Petrolatum is typically perceived as soothing when applied to the human skin.

"Usable lip balm" refers to a section of lip balm material which remains in a location in a lip balm receptacle such that the consumer can continue to use the lip balm receptacle to apply the lip balm material without having to disassemble a portion which originally held the lip balm material in order to reach the material or without having to melt the lip balm material to pour the material out ("de-potting" the lip balm material).

The terms "about" or "approximately" mean within an acceptable range for the particular parameter specified as determined by one of ordinary skill in the art, which will depend, in part, on how the value is measured or determined, i.e., the limitations of the measurement system. For example, "about" can mean a range of up to 10% of a given value.

"Percent" or "%" as used herein refers to the percentage by weight of the total composition, unless otherwise specified.

The invention is further described by way of the following illustrative examples. These examples set out analyses of the lip balm applicators 50 within the concept of the present invention; however, the present invention is not limited by these examples. Additional variations within the concept of the invention will be clear to the designer, engineer, or scientist, and their preparation or configuration will be within the skilled person's competence.

Example 1

One advantage of the lip balm applicator 50 of the present invention is the percentage of usable product compared to two domed lip balm products that are currently commercially available. The lip balm applicator 50 of the present invention is filled to target commercial fill volume with molten liquid lip balm composition and cooled to a semi-solid state. The average package weight of the lip balm applicator filled with lip balm is determined by measuring thirty samples, ten each of three different lip balm flavors. The usable lip balm, viz., the domed section above the stabilizers 302, is removed from each lip balm applicator, and the lip balm applicator is weighed again, the difference being the weight of the usable lip balm. The average weight of the empty lip balm applicator is measured by removing all lip balm material. The average weight of the total fill, i.e., the average net product weight, is calculated by subtracting the weight of the empty lip balm applicator from the weight of the filled lip balm applicator. The average percent usable product is calculated by dividing the average weight of the usable product by the average weight of the net product filled into the lip balm applicator.

Essentially the same procedure is repeated for a normal commercial fill volume of a domed lip balm composition in a substantially spherical lip balm holder (thirty samples consisting of ten each of three different flavors) and a domed lip balm composition in a cubical lip balm holder (thirty samples consisting of ten each of three different flavors). Both commercially available products consist of one lip balm per lip balm holder and are compared to one lip balm applicator of the dual-ended lip balm container 60 of the present invention. The results are shown in Table 1.

TABLE 1

Comparison of the Weight of Usable Product in Three Lip Balm Holders

| holder type | usable product (g) avg (±s.d.) | unusable product (g) avg | total fill (g) avg (±s.d.) | % usable product avg |
|---|---|---|---|---|
| present invention | 3.401 (±0.077) | 2.127 | 5.528 (±0.048) | 61.52 |
| spherical | 5.066 (±0.099) | 3.385 | 8.451 (±0.217) | 59.95 |
| cube | 3.260 (±0.078) | 3.398 | 6.658 (±0.147) | 48.96 |

These data demonstrate that the lip balm applicator of the present invention provides a slightly higher percentage of usable lip balm compared to two commercially available domed lip balm products.

The lip balm applicator of the present invention should be used and stored at ambient temperatures, preferably below about 30° C., and more preferably at or below about 25° C. However, if the consumer accidentally exposes the lip balm applicator to excessively high temperatures, the percentage of usable lip balm available in the lip balm applicator 50 of the present invention should remain above the percentage of usable lip balm in lip balm holders with open-type support mechanisms. To investigate the differences, extreme heating and cooling cycle experiments are performed on lip balm applicators of the invention and compared with the same commercially available domed lip balm holders as above. These experiments are performed with each tip balm holder placed in an upright positional orientation and repeated with each lip balm holder placed in a side positional orientation, i.e., lying on its side 90° from upright. Initially, the lip balm holders contain a commercial amount of the respective lip balm composition. For each product, the lip balm holder is heated to an extremely high temperature of 70° C.—well above the melting point of the domed lip balm inside and well above the recommended storage temperature—and then cooled to re-solidify the lip balm in an upright or side position, rather than the inverted position which is used for filling the lip balm holders. Once congealed, essentially the same procedure as described above for the three types of lip balm holders is repeated, using five samples of each receptacle type and for each position. Thus, the procedure is repeated for a total of five upright measurements and five side measurements, and the average values are reported. These results are shown in Table 2 for the upright position measurements and Table 3 for the side position measurements.

TABLE 2

Comparison of the Weight of Usable Product in Three Lip Balm Holders After an Upright Position Extreme Heating and Cooling Cycle

| holder type | usable product (g) avg (±s.d.) | unusable product (g) avg | total fill (g) avg (±s.d.) | % usable product avg |
|---|---|---|---|---|
| present invention | 2.494 (±0.081) | 2.932 | 5.426 (±0.043) | 45.96 |
| spherical | 0.000 (±0.000) | 8.325 | 8.325 (±0.227) | 0.00 |
| cube | 1.880 (±0.027) | 4.982 | 6.862 (±0.061) | 27.40 |

These data demonstrate that the lip balm applicator of the present invention provides a higher percentage of usable lip balm after an upright position extreme heating and cooling cycle compared to two commercially available domed lip balm products.

TABLE 3

Comparison of the Weight of Usable Product in Three Lip Balm Holders After a Side Position Extreme Heating and Cooling Cycle

| holder type | usable product (g) avg (±s.d.) | unusable product (g) avg | total fill (g) avg (±s.d.) | % usable product avg |
|---|---|---|---|---|
| present invention | 3.032 (±0.036) | 2.314 | 5.346 (±0.061) | 56.72 |
| spherical | 1.968 (±0.499) | 5.817 | 7.785 (±0.586) | 25.28 |
| cube | 2.662 (±0.049) | 3.882 | 6.544 (±0.093) | 40.68 |

These data demonstrate that the lip balm applicator of the present invention provides a higher percentage of usable lip balm after a side position extreme heating and cooling cycle compared to two commercially available domed lip balm products.

We claim:

1. A method for filling a lip balm mold comprising transferring a molten lip balm composition into the lip balm mold through an aperture in a partition in the lip balm mold to a fill level approaching the partition but not touching the partition;

wherein said lip balm mold comprises:

a liner comprising a domed upper liner section, a lower liner section with a liner perimeter, a liner exterior, a liner interior having a lower liner interior and an upper liner interior, and a first liner engagement assembly on the lower liner interior; wherein the liner perimeter optionally has a cap engagement assembly; and a base comprising an upper base section having a base top edge, a lower base section, a partition dividing the upper base section and the lower base section and extending to a base perimeter, the partition having a partition bottom and a partition top, with the partition top having an outer partition top section and an inner partition top section, an aperture in the partition, an upper base section exterior wall comprising a second liner engagement assembly which aligns with the first liner engagement assembly and engages the lower liner interior with the upper base section exterior wall, an upper base section interior wall, a plurality of stabilizers arising from a first area adjacent to the upper base section interior wall on the inner partition top section, rising to a level at or near horizontal with the base top edge and extending radially inward to a second area overhanging the aperture, a gap between each stabilizer and the upper base section interior wall, and a base engagement assembly on the lower base section which provides releasable engagement of a lower base section on a first lip balm mold with a lower base section on a lip balm applicator, a lip balm dispenser, or a second lip balm mold, wherein the base has three to six sides;

wherein the liner and the base are engaged through the first liner engagement assembly and the second liner engagement assembly, and the engaged liner and base are inverted such that the partition bottom is facing upward.

2. The method for filling a lip balm mold of claim 1, wherein the fill level provides a pocket of air between the partition and the molten lip balm composition.

3. The method for filling a lip balm mold of claim 2, wherein the pocket of air is about 0.5 mm to about 7 mm thick.

4. The method for filling a lip balm mold of claim 3, wherein the pocket of air is about 1 mm to about 5 mm thick.

5. The method for filling a lip balm mold of claim 4, wherein the pocket of air is about 1.5 mm to about 4 mm thick.

* * * * *